US009390728B2

(12) United States Patent
Kim et al.

(10) Patent No.: US 9,390,728 B2
(45) Date of Patent: Jul. 12, 2016

(54) VOICE ANALYSIS APPARATUS, VOICE SYNTHESIS APPARATUS, VOICE ANALYSIS SYNTHESIS SYSTEM

(71) Applicant: GWANGJU INSTITUTE OF SCIENCE AND TECHNOLOGY, Gwangju (KR)

(72) Inventors: Hong-Kook Kim, Gwangju (KR); Kwang-Myung Jeon, Gwangju (KR)

(73) Assignee: GWANGJU INSTITUTE OF SCIENCE AND TECHNOLOGY, Gwangju (KR)

( * ) Notice: Subject to any disclaimer, the term of this patent is extended or adjusted under 35 U.S.C. 154(b) by 257 days.

(21) Appl. No.: 13/851,446

(22) Filed: Mar. 27, 2013

(65) Prior Publication Data

US 2013/0262098 A1 Oct. 3, 2013

Related U.S. Application Data

(60) Provisional application No. 61/615,903, filed on Mar. 27, 2012.

(51) Int. Cl.

| | |
|---|---|
| ***G10L 19/00*** | (2013.01) |
| ***G10L 21/00*** | (2013.01) |
| ***G10L 25/90*** | (2013.01) |
| ***G10L 25/93*** | (2013.01) |
| ***G10L 21/02*** | (2013.01) |
| ***G10L 13/00*** | (2006.01) |
| ***G10L 13/02*** | (2013.01) |

(52) U.S. Cl.

CPC ..... *G10L 25/90* (2013.01); *G10L 13/02* (2013.01)

(58) Field of Classification Search

USPC ..... 704/207, 208, 220, 225, 226, 258, 260

See application file for complete search history.

(56) References Cited

U.S. PATENT DOCUMENTS

| | | | | |
|---|---|---|---|---|
| 7,562,018 | B2 * | 7/2009 | Kamai | G10L 13/10 704/258 |
| 2010/0049522 | A1 * | 2/2010 | Tamura | G10L 13/033 704/264 |

(Continued)

FOREIGN PATENT DOCUMENTS

| | | |
|---|---|---|
| JP | 2012-048154 A | 3/2012 |
| KR | 10-1997-0012548 | 3/1997 |

OTHER PUBLICATIONS

Han et al, "Optimum MVF estimation-based two-band excitation for HMM-based speech synthesis", 2009, In ETRI J., vol. 31, No. 4, pp. 457-459.*

(Continued)

*Primary Examiner* — Olujimi Adesanya

(74) *Attorney, Agent, or Firm* — Saliwanchik, Lloyd & Eisenschenk

(57) ABSTRACT

A speech analysis apparatus is provided. An F0 extraction part extracts a pitch value from speech information. A spectrum extraction part extracts spectrum information from the speech information. An MVF extraction part extract a maximum voiced frequency and allows boundary information for respectively filtering a harmonic component and a non-harmonic component to be obtained. According to the speech analysis apparatus, speech synthesis apparatus, and speech analysis synthesis system of the present invention, speech that is closer to the original voice and is more natural may be synthesized. Also, speech may be represented with less data capacity.

16 Claims, 8 Drawing Sheets

(56) References Cited

U.S. PATENT DOCUMENTS

| | | | | |
|---|---|---|---|---|
| 2010/0217584 | A1* | 8/2010 | Hirose | G10L 21/0208 704/206 |
| 2012/0053933 | A1 | 3/2012 | Tamura et al. | |
| 2012/0123782 | A1* | 5/2012 | Wilfart et al. | 704/264 |

OTHER PUBLICATIONS

Stylianou, "Modeling speech based on harmonic plus noise models", 2005, In Nonlinear speech modeling, pp. 244 -260.*

Bjorkan, "Speech Generation and Modification in Concatenative Speech Synthesis", 2010, Dissertation, Norwegian University of Science and Technology, pp. 1-186.*

Vandromme, "Harmonic Plus Noise Model for Concatenative Speech Synthesis", 2005, Diploma thesis, IDIAP, 2005, IDIAP-RR 05-37, pp. 1-70.*

Kim et al, "HMM-based Korean speech synthesis system for hand-held devices," 2006, In Consumer Electronics, IEEE Transactions on , vol. 52, No. 4, pp. 1384-1390.*

Sawicki et al "Design of text to speech synthesis system based on the harmonic and noise model", 2009, Zeszyty naukowe politechniki Bialostockiej, 2009.—pp. 111-125.*

Přibil et al, "Two Synthesis Methods Based on Cepstral Parameterization", 2002, In Radioengineering 11(2), pp. 35-39 (2002).*

Office Action dated Jun. 20, 2013 in Korean Application No. 10-2012-0069776.

Office Action dated Dec. 26, 2013 in Korean Application No. 10-2012-0069776.

* cited by examiner

VOICE ANALYSIS APPARATUS, VOICE SYNTHESIS APPARATUS, VOICE ANALYSIS SYNTHESIS SYSTEM

CROSS-REFERENCE TO RELATED APPLICATION

This application claims the benefit under 35 U.S.C. §119 of U.S. Patent Application No. 61/615,903, filed Mar. 27, 2012, which is hereby incorporated by reference in its entirety.

BACKGROUND

The present disclosure relates to a voice analysis apparatus, a voice synthesis apparatus, and a voice analysis synthesis system.

Speech synthesis methods are classified into a unit-selection speech synthesis method and a statistical parametric speech synthesis method.

While the unit-selection speech synthesis method may synthesize high quality speech, it has limitations, such as excessive database dependency and difficulty in voice characteristics transformation. The statistical parametric speech synthesis method has advantages such as low database dependency, a small database size, and easy voice characteristics transformation, whereas it has a disadvantage, such as low quality of synthesized speech. Based on those characteristics, any one of the above two methods is selectively used for speech synthesis.

As a kind of statistical parametric speech synthesis, the Hidden Markov Model (HMM)-based speech synthesis system has been well known. In the HMM-based speech synthesis system, core factors determining speech quality are representation/reconstruction of a speech signal, training accuracy of sentence database, and smoothing intensity of output parameters generated in a training model.

Meanwhile, as related art speech modeling methods for representation/reconstruction of a speech signal, a Pulse or Noise (PoN) model, and a speech transformation and representation using adaptive interpolation of weighted spectrum (STRAIGHT) model have been proposed. The PoN model is a speech synthesis method using excitation and spectral parts divided. The STRAIGHT model represents speech using three parameters. The three parameters consist of a pitch value F0, spectrum smoothed in a frequency region, and aperiodicity for reconstructing aperiodicity of a signal disappearing in the course of spectral smoothing.

Since the STRAIGHT model use a small number of parameters, it may obtain an effect in that degeneration of reconstructed speech is small. However, the STRAIGHT model has drawbacks such as difficulty in F0 search, an increase in complexity of signal representation due to extraction of aperiodicity spectrum. Thus, a new model for representation/reconstruction of a speech signal is required.

BRIEF SUMMARY

Embodiments provide a speech analysis apparatus, a speech synthesis apparatus, and a speech analysis synthesis system that enable to synthesize speech closer to the original voice.

Embodiments also provide a speech analysis apparatus, a speech synthesis apparatus, and a speech analysis synthesis system that enables to represent speech with less data.

In one embodiment, a speech analysis apparatus includes: an F0 extraction part extracting a pitch value from speech information; a spectrum extraction part extracting spectrum information from the speech information; and an MVF extraction part extracting a maximum voiced frequency and allowing boundary information for respectively filtering a harmonic component and a non-harmonic component to be obtained.

In another embodiment, a speech synthesis apparatus allowing speech to be synthesized after a harmonic component and a non-harmonic component are separately generated, the apparatus includes: a low-pass filter performing a filtering when the harmonic component is generated; and a high-pass filter performing a filtering when the non-harmonic component is generated.

In further another embodiment, a speech analysis synthesis system includes: a speech signal analysis part analyzing a speech signal; a statistical model training part training a parameter analyzed by the speech signal analysis part; a database storing the parameter trained by the statistical model training part; a parameter generating part extracting the parameter corresponding to a specific character from the database when a character is inputted; and a synthesis part synthesizing speech by using the parameter, wherein the parameter comprises a pitch value, spectrum information, and an MVF value which is defined as a boundary frequency value between a section having a relatively large harmonic component and a section having a relatively small harmonic component.

According to the speech analysis apparatus, speech synthesis apparatus, and speech analysis synthesis system of the present invention, speech that is closer to the original voice and is more natural may be synthesized. Also, speech may be represented with less data capacity.

The details of one or more embodiments are set forth in the accompanying drawings and the description below. Other features will be apparent from the description and drawings, and from the claims.

DETAILED DESCRIPTION

Figure 1:
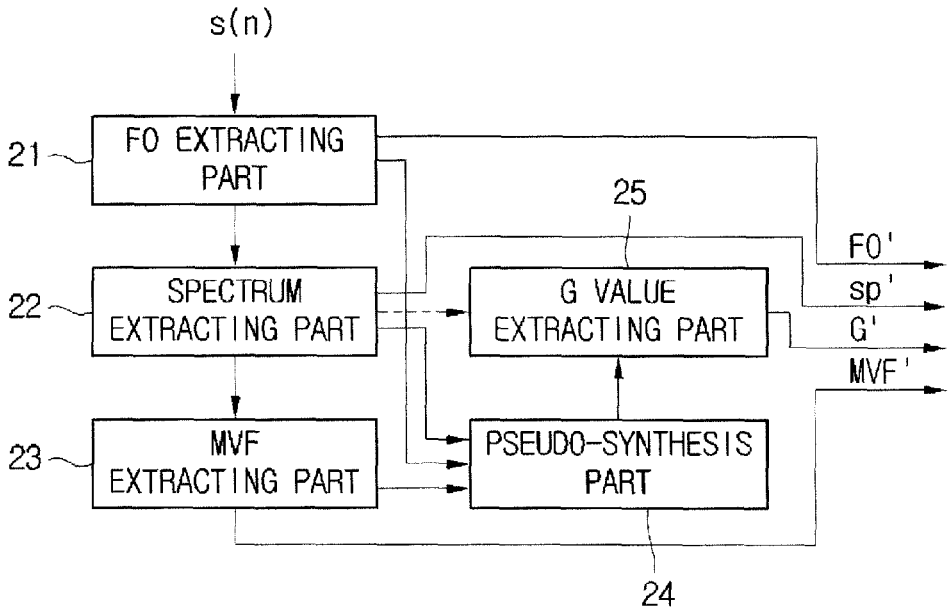
FIG. 1 is a block diagram view of a speech analysis apparatus according to an embodiment.

Reference will now be made in detail to the embodiments of the present disclosure, examples of which are illustrated in the accompanying drawings.

A speech modeling method according to an embodiment will now be described.

It is known that a speech signal consists of a harmonic component and a non-harmonic component. A speech modeling method according to an embodiment analyzes the harmonic component and the non-harmonic component, respectively, based on such a fact. Equation 1 indicates that an arbitrary given speech signal consists of a harmonic component and a non-harmonic component.

$$s(n)=s_h(n)+s_{nh}(n), \quad \text{[Equation 1]}$$

where s(n) is a given speech signal, $s_h(n)$ is a harmonic signal, and $s_{nh}(n)$ is a non-harmonic signal. A speech representation model according to the embodiment is characterized by separately processing and synthesizing the harmonic signal and the non-harmonic signal. The speech representation model defined in the embodiment may be named a harmonic non-harmonic (HNH) model. In the below description, the speech representation model may be named a harmonic non-harmonic speech model or an HNH model.

Herein, $s_h(n)$ is a periodic accumulation of unit speech components $f_m(n)$, and may be represented as Equation 2.

$$s_h(n) = \sum_m \left\{ \{ \sum_l f\left(n - l\frac{S}{p(m)}, m\right) \} \right\}, \quad \text{[Equation 2]}$$

where m is an F0 index that is a pitch value, l is an accumulation index, and S is a sampling rate. Also, f(n,m) meaning one frame is different values on time axis for each m, and its length is consistently N. m may be defined as a predetermined range that is represented by one F0 value. In the present embodiment, N is 1024. p(m) indicates a F0 value for each m, in which the F0 value may represent pitch information. In the case of p(m)=0, $s_h(n)$ is 0, and thus the corresponding region may be treated as an unvoiced region free of a harmonic component without calculating Equation 2.

In Equation 2, it is noted that the range of l is followed by the condition of Equation 3.

$$l\frac{S}{p(m)} < M, \quad \text{[Equation 3]}$$

where M is the duration of p(m) in samples, i.e., may be considered to be the duration of the same P(m). In this embodiment, M is set as 80, which is 5 ms in time with a sampling frequency (S) of 16 kHz. For example under the above condition, when p(m) is 200 Hz, since 1 has only the value of 0, f(n,m) is only once added, when p(m) is 201 Hz, since 1 has the values of 0 and 1, one step preceding value on a time axis, and a current value may be added, and when p(m) is 401 Hz, since 1 has the values of 0, 1, and 2, one step preceding or two step preceding value and the current value may be added. This process is necessary for acquirement of an accurate speech signal in relation to the subsequent process of a frequency region.

Meanwhile, in Equation 2, h(n,m) acts as a low pass filter with a specific cut-off frequency, and the cut-off frequency may be defined by v(m) which is a boundary v(m) between harmonic and non-harmonic. In other words, v(m) may mean a boundary value between a section having a sufficiently high harmonic energy and a section not having the sufficiently high harmonic energy.

In Equation 1, a non-harmonic speech signal, snh(n) may be modeled as Equation 4, similarly to the harmonic speech signal.

$$s_{nh}(n) = G\sum_m \left\{ \sum_l \left\{ f\left(n - l\frac{S}{p_{nh}}, m\right) * r(n) \right\} * h_H(n, m) \right\} \quad \text{[Equation 4]}$$

$$P_{nh} = \begin{cases} 4p(m) & p(m) > 0 \\ 800 & \text{else.} \end{cases}$$

The non-harmonic speech signal may be also provided based on the harmonic speech signal. In Equation 4, f(n,m) is consisted of different values for each m on the time axis like Equation 2, and its length is consistently N. r(n) is white noise and is Gaussian-distributed random sequence. As represented in a lower side of Equation 4, when p(m) is greater than 0, it becomes 4p(m), otherwise, it becomes 800. Also, $h_H(n,m)$ is a high pass filter and may use as the cut-off frequency, v(m) that is the boundary value between the harmonic component and the non-harmonic component.

Also, G is a gain value of the non-harmonic speech signal for similarly controlling a power ratio of the harmonic component and the non-harmonic component to that of input speech.

As described previously, real speech signals contain both harmonic and non-harmonic components in a voiced region. To more fully realize such a characteristic in the speech modeling method according to the embodiment, filter values contained in Equations 2 and 3 may be defined as Equation 5.

$$|H_L(k, m)| = \begin{cases} \frac{1}{N - v(m)}(N - k) & k > (m) \\ 1 & \text{otherwise} \end{cases} \quad \text{[Equation 5]}$$

$$|H_H(k, m)| = 1 - |H_L(k, m)|,$$

where v(m) is a maximum voiced frequency (MVF). Therefore, when analysis is performed in the frequency region, the absolute value of $H_L(k,m)$ decreases when k is greater than v(m), and the absolute value of $H_L(k,m)$ becomes 1 when k is less than v(m). The absolute value of $H_H(k,m)$ is a value obtained by subtracting the absolute value of $H_L(k,m)$ from 1.

Figure 4:
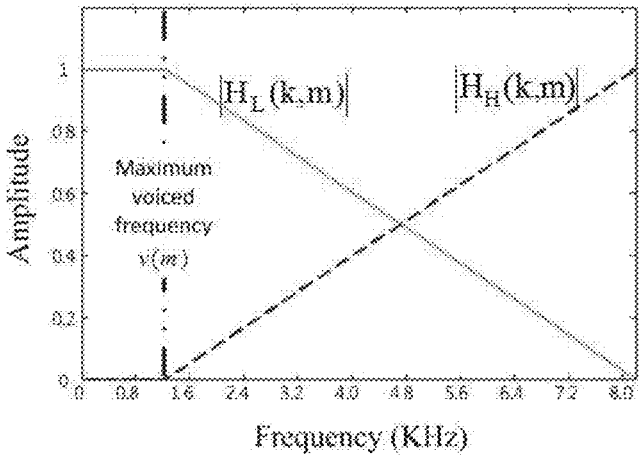
FIG. 4 is a graph explaining the function of a boundary filter.

Equation 5 may be provided in the form of a graph as shown in FIG. 4.

According to the above description, when real speech is represented using the HNH model, the speech modeling method according to the embodiment may represent and reconstruct speech by using four parameters.

1. p(m): Pitch Value

First, pitch value p(m) is given as F0 . This value may be obtained by applying the well known robust algorithm for pitch tracking (RAPT) technology. It will be construed that the RAPT technology is included in the description of the present application, and it is natural that p(m) may be found through methods other than the RAPT technology.

2. F(k,m): Spectral Information

Secondly, spectral information F(k,m) may be obtained by FET transformation of f(n,m), and is represented as Equation 6.

$$F(k, m) = \left|\sum_{n=0}^{N-1} s(n + mn_d)w(n, m)\exp\left(-j\frac{2\pi kn}{N}\right)\right|,$$

$$w(n, m) = \frac{1}{p(m)}\exp\left(-\pi\left(\frac{n}{p(n)}\right)^2\right),$$

where w(n,m) refers to a F0 adaptive window function, and this function may smooth high harmonics to inhibit frequency interference between adjacent spectrums.

3. v(m): Maximum Voiced Frequency (MVF)

Thirdly, maximum voiced frequency (MVF) may be calculated through two steps. A method of calculating the MVF will be described with reference to FIG. 5.

Figure 5:
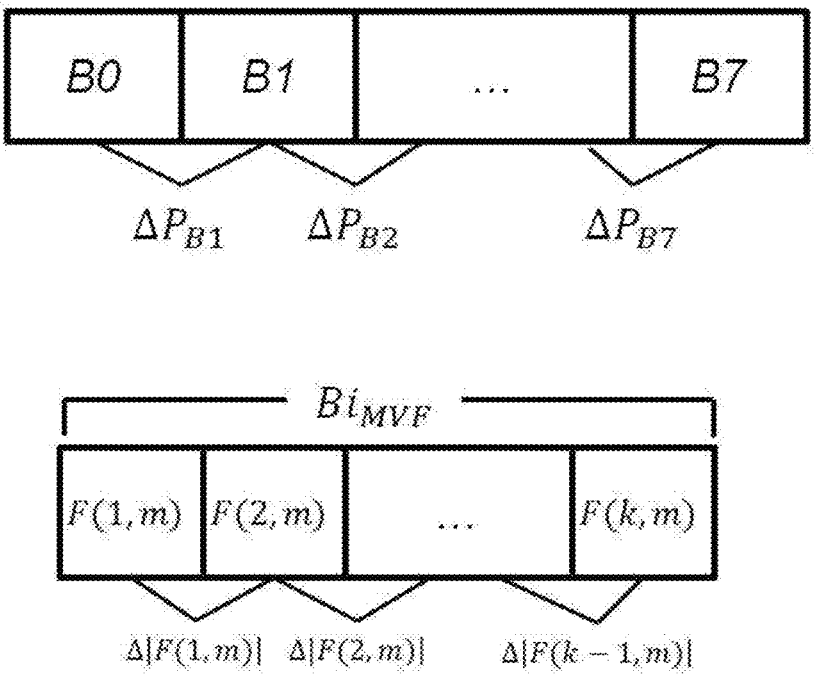
FIG. 5 is a schematic view explaining a method of obtaining a maximum voiced frequency.

Referring to FIG. 5, a sub-band index having a high energy difference is searched using a brief search filter. In detail, a specific frame is divided into several sub-bands (B), and a sub-band index where the mean energy difference (ΔPBi) between two adjacent sub-bands is highest is searched. Next, a specific position having the highest amplitude between two adjacent samples in a sub-band region ($F_{iHB}$(j,m)) obtained by the brief search filter is searched using a fine search filter. Operation of the fine search filter may be represented as Equation 7.

$$v(m) = \text{argmax}\Delta|_j F_{iHB}(j, m)| \quad \text{[Equation 7]}$$

According to Equation 7, in the frame of the specific time represented as m, v(m) may be obtained. argmax is a function of obtaining a j value which makes the value of the function be highest.

When the value of v(m) is found, $H_L$(n,m) and $H_H$(n,m) may be obtained using Equation 5.

4. G: Gain Value

Fourthly, the gain value may be obtained by respectively obtaining the gain value ($G_h$) of the harmonic component and the gain value ($G_{nh}$) of the non-harmonic component and then obtaining their ratio. Hereinafter, an equation for obtaining the gain value of each of the harmonic component and the non-harmonic component.

$$G_h = \frac{\sum_{n\in Voiced} |s(n)|^2}{\sum_{n\in Voiced} |\hat{s}_h(n)|^2}, \quad \text{[Equation 8]}$$

$$G_{nh} = \frac{\sum_{n\in Unvoiced} |s(n)|^2}{\sum_{n\in Unvoiced} |\hat{s}_{nh}(n)|^2}.$$

In Equation 8, s(n) is an input speech signal, and $\hat{s}_h$ and $\hat{s}_{nh}$ are speech signals which are arbitrarily reconstructed by the pseudo-synthesis part (see 24 of FIG. 1) by using the pitch value, the spectrum information and the maximum voiced frequency. The squares of the absolute values of these speech signals are denoted as the gain values.

Meanwhile, a large portion of energy of the speech signal is positioned at a low frequency region, i.e., a harmonic region, and in the harmonic speech signal, the reconstructed speech signal almost corresponds to the input speech signal. Unlike this, in the case of the non-harmonic signal, the reconstructed non-harmonic signal is not accurate due to its randomness in the number of times of OLA. Therefore, a final gain value may be represented as a relative ratio ($G_{nh}/G_h$) of the gain value of the non-harmonic component over the gain value of the harmonic component. By obtaining the gain values as above, the proportions of the harmonic component and the non-harmonic component may be maintained even without an additional operation.

As suggested in the above description, the HNH model according to the embodiment may analyze and synthesize speech by using the parameters denoted as the pitch value (p(m)), the spectrum information (F(k,m)), the maximum voiced frequency (MVF) (v(m)), and the gain value (G). An apparatus for specifically analyzing and synthesizing speech will be understood with reference to the explanation to be described later.

Figure 6:
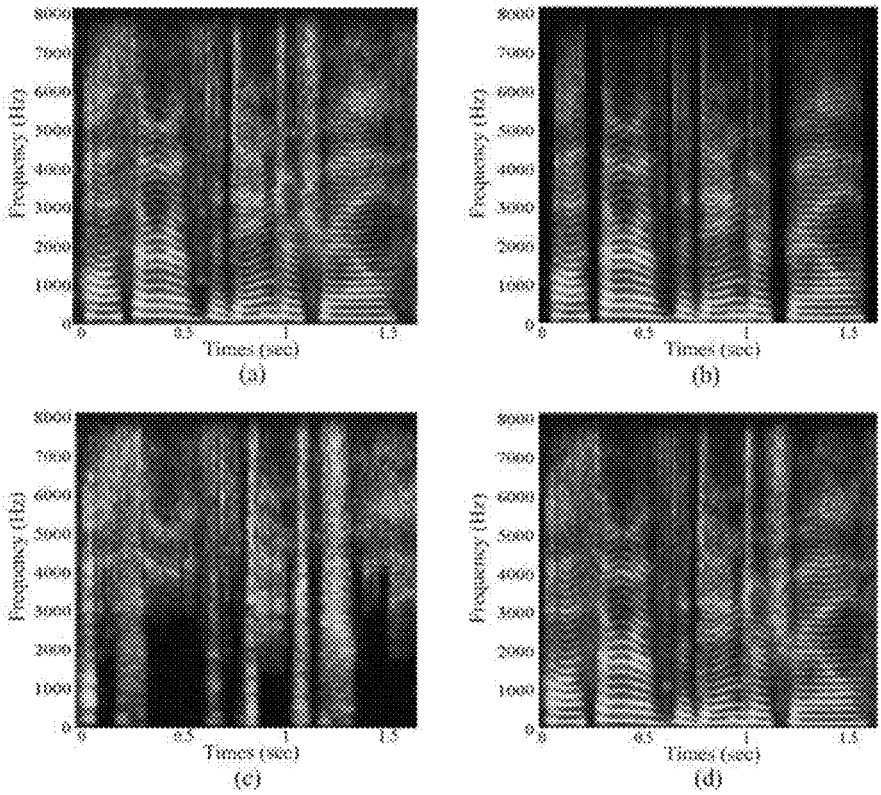
FIG. 6 is spectrograms of original voice and synthesized speech.

FIG. 6 illustrates spectrograms of original speech and synthesized speech.

FIG. 6A is the spectrogram of the original speech (s(n)), FIG. 6B is the spectrogram of the artificially synthesized speech ($\hat{s}_h$ (n)) of the harmonic component, FIG. 6C is the spectrogram of the artificially synthesized speech ($\hat{s}_{nh}$ (n)) of the non-harmonic component, FIG. 6D is the spectrogram of the artificially synthesized speech ($\hat{s}$(n)) obtained by combining the artificially synthesized harmonic component and the artificially synthesized non-harmonic component. Referring to FIG. 6, it may be seen that the synthesized speech of the harmonic and non-harmonic speech model is very similar to the original speech.

FIG. 1 is a block diagram of a speech analysis apparatus according to an embodiment.

Referring to FIG. 1, a block for obtaining each of values required for representation of harmonic and non-harmonic models when a speech signal s(n) is inputted, is provided. In detail, an F0 extracting part 21 extracting a pitch value (p(m)), a spectrum extracting part 22 extracting spectrum information (F(k,m)), and an MVF extracting part 23 extracting a maximum voiced frequency (MVF) (v(m)) are provided. Also, in order to obtain a gain value G), a pseudo-synthesis part 24 pseudo-synthesizing speech by using the pitch value, the spectrum information, and the maximum voiced frequency respectively extracted by the F0 extracting part 21, the spectrum extracting part 22, and the MVF extracting part 23 is further provided. The pseudo-synthesis part 24 artificially, separately synthesizes a harmonic component and a non-harmonic component, and then adds the two synthesized components to pseudo-synthesize artificial speech. A gain value extracting part 25 compares the harmonic component and the non-harmonic component which are pseudo-synthesized by the pseudo-synthesis part 24, to obtain the gain value.

Through the above processes, the pitch value (F0 ), the spectrum information (sp), the maximum voiced information (MVF), and the gain value (G) for the specific speech signal (s(n)) are extracted. Thereafter, a training process is performed by the statistical parametric-based speech synthesis method, such as the Hidden Markov Model (HMM). By the training process, four parameters representing the specific speech signal (s(n)) may be deduced and stored in database. The specific speech signal may be provided as phonemes, syllables, words, or the like.

A speech analysis synthesis system according to an embodiment will be described in more detail with reference to the block diagram of FIG. 3.

Figure 3:
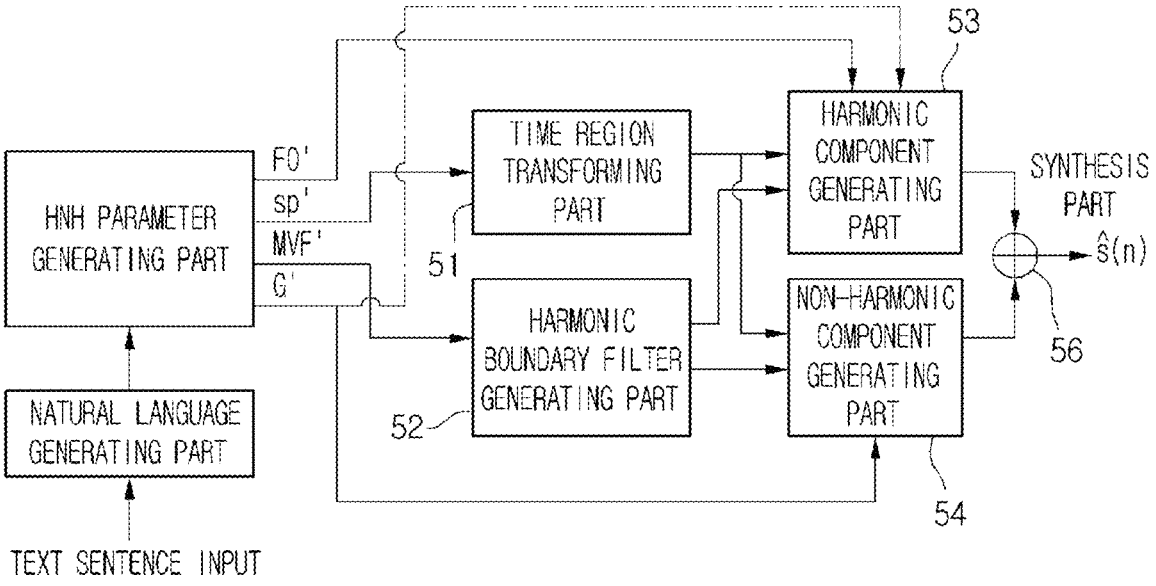
FIG. 3 is a detailed block diagram showing an inner configuration of a harmonic non-harmonic parameter generating part.

FIG. 3 is a block diagram of a speech analysis synthesis system according to an embodiment.

Referring to FIG. 3, the speech analysis synthesis system includes a training speech database 1 storing a speech signal provided for training, a harmonic non-harmonic (HNH) analysis part 2 analyzing the speech signal provided from the training speech database 1 to extract four parameters necessary for a harmonic non-harmonic model, a statistical model training part 3 performing a training performing a training process necessary for the statistical parametric-based speech synthesis method, a harmonic non-harmonic parameter database 4 extracting and storing a parameter representing a specific speech signal provided through the training in the statistical model training part 3, a harmonic non-harmonic parameter generating part 5 generating each parameter corresponding to a corresponding sentence when the sentence is inputted through a natural language processing part 6, and a harmonic non-harmonic synthesis part artificially synthesizing speech by using the four parameters generated by the harmonic non-harmonic parameter generating part 5.

The four parameters may be the pitch value (p(m)), the spectrum information (F(k,m)), the maximum voiced frequency (MVF) (v(m)), and the gain value (G). It may be understood that a detailed configuration of the harmonic non-harmonic analysis part 2 includes the block diagram of FIG. 1. The natural language processing part 6 may perform a work to analyze daily lift language in terms of form, meaning, conversation, etc., and convert the daily life language to a computer processible format.

Figure 2:
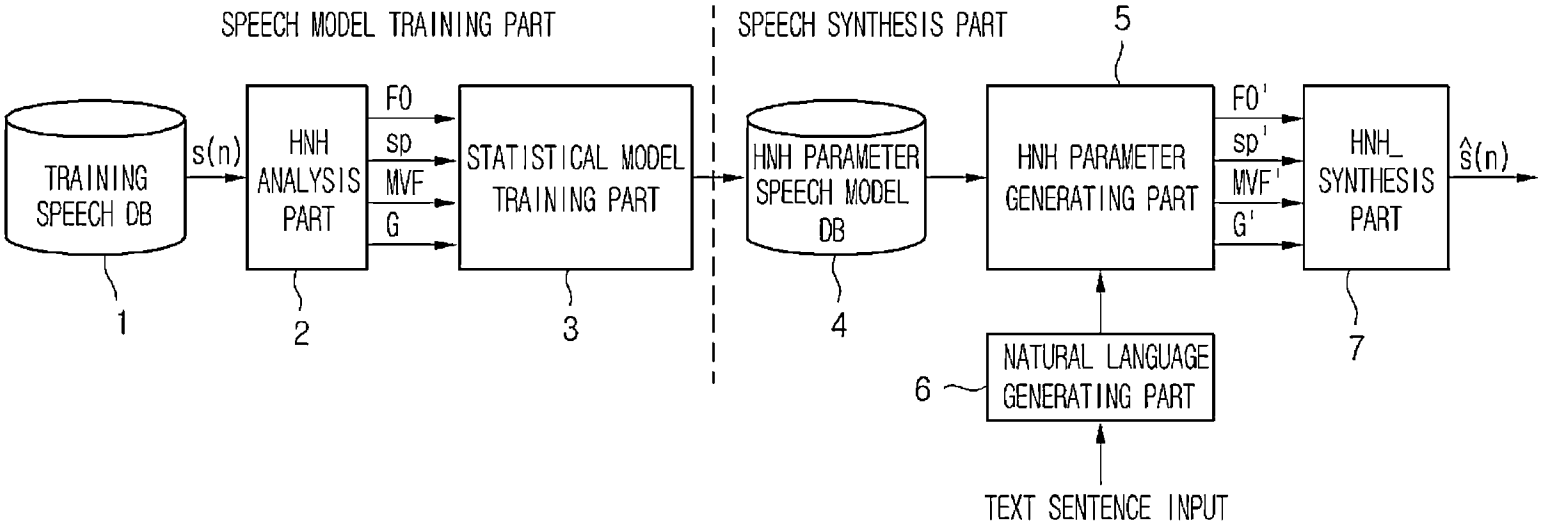
FIG. 2 is a block diagram view of a speech analysis synthesis apparatus according to an embodiment.

FIG. 2 is a block diagram showing a detailed inner configuration of the harmonic non-harmonic parameter synthesis part.

Referring to FIG. 2, the harmonic non-harmonic parameter synthesis part synthesizes an artificially synthesized speech signal ($\hat{s}_h$ (n)) and an artificially synthesized non-harmonic speech signal ($\hat{s}_{nh}$ (n)) by using four parameters of F0 ' (pitch value), sp' (spectrum information), MVF' (maximum voiced frequency), and G' (gain value) which are outputted from the harmonic non-harmonic parameter generating part 5.

In detail, the harmonic non-harmonic parameter synthesis part includes a time region transforming part 51 transforming the spectrum information sp' in a frequency region to a time region to output frame information (f'(n,m)), and a harmonic boundary filter generating part 52 generating a boundary filter according to Equation 5 by using the maximum voiced frequency (MVF'). The harmonic boundary filter generating part 52 generates a harmonic boundary filter ($h'_H(n,m)$) applied to the synthesis harmonic speech signal, and a non-harmonic boundary filter ($h'_{NH}(n,m)$) applied to the synthesis non-harmonic speech signal. The pitch value, the boundary filters, the frame information, and the gain value are transmitted to a harmonic component generating part 53 and a non-harmonic component generating part 54 to synthesize a synthesis harmonic speech signal and a synthesis non-harmonic speech signal, respectively. The synthesized harmonic speech signal and non-harmonic speech signal are synthesized in a synthesis part 56 for output.

In detail, the harmonic component generating part 53 may synthesize the harmonic component by using the pitch value, the frame information, the gain value, and the boundary filter provided as a low pass filter. The non-harmonic component generating part 54 may synthesize the non-harmonic component by using the pitch value, the frame information, the gain value, and the boundary filter provided as a high pass filter. The harmonic component generating part 53 and the non-harmonic component generating part 54 may be synthesized by Equations 2 and 4, respectively.

Hereinafter, results are analyzed using the HNH model according to the embodiment, and are analyzed and compared using the synthesized speech signal, the PoN model, and the STRAIGHT model.

<Size Comparison>

First, data sizes used in the modeling method are compared.

TABLE 1

| Speech model | Parameter | Parameter size | Total size |
|---|---|---|---|
| PoN model | F0 | 1 | 40 |
| | Spectrum (MFCC) | 39 | |
| STRAIGHT model | F0 | 1 | 45 |
| | Band Aperiodicity | 5 | |
| | Spectrum (MFCC) | 39 | |
| Harmonic non-harmonic model | F0 | 1 | 42 |
| | Spectrum (MFCC) | 39 | |
| | MVF | 1 | |
| | Gain value | 1 | |

Referring to Table 1, it may be see that the harmonic non-harmonic model according to the embodiment has a larger total data size than the PoN model, but has a smaller total data size than the STRAIGHT model. Considering that in the case of the PoN model, the synthesized speech quality is coarse and thus it is difficult to compare the data sizes, it may be seen that the harmonic non-harmonic model decreases in total data size by 3, compared with the STRAIGHT model.

<Quality Evaluation 1>

In the quality evaluation 1, after reference speeches were analyzed and synthesized by the PoN model, the STRAIGHT model, and the HNH model, both objective and subjective speech quality measurements were performed in order to evaluate the quality of the synthesized speech and its similarity to the original speech. Sample data were prepared as follows. Ten samples were used for reference from each of the CMU-ARCTIC-SLT and CMU-ARCTIC-AWB speech database.

First, the subject speech quality evaluation includes a PCM reference speech, and was performed via an MOS (Mean Opinion Scores) listening test using the speeches synthesized by the PoN model/STRAIGHT model/HNH model. Eleven listeners participated in the test. For each sample, scores were recorded on a 1 to 4.5 scale; hidden references also existed in the test set.

The objective evaluation was performed via a PESQ. Here, four sets of 20 samples used in the MOS listening test were reused in the object evaluation. Note that the tests were separately averaged over samples from CMU-ARCTIC-SLT and CMU-ARCTIC-AWB speech database.

Figure 7:
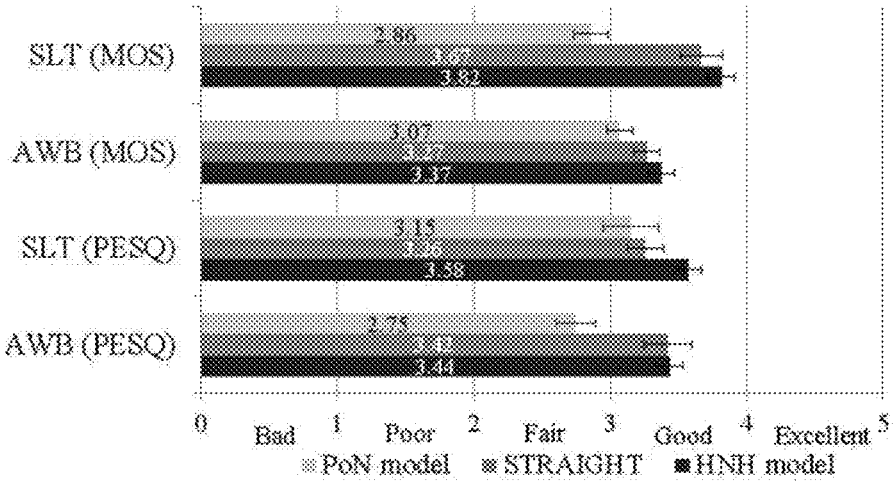
FIG. 7 is a diagram showing MOS results and PESQ results obtained by the quality evaluation 1.
Figure 8:
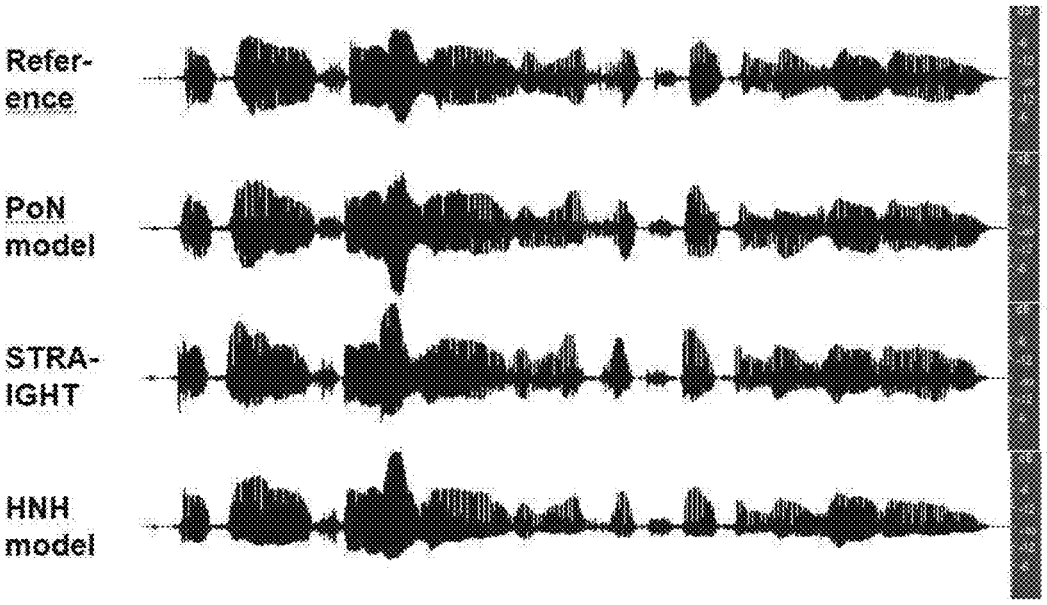
FIG. 8 is a graph showing waveforms of samples used in the quality evaluation 1.

Both the MOS and PESQ results are presented in FIG. 7. FIG. 8 is a graph comparing waveforms of examples used in the quality evaluation 1. It may be known from FIG. 7 that the HNH mode shows the best evaluation.

Figure 9:
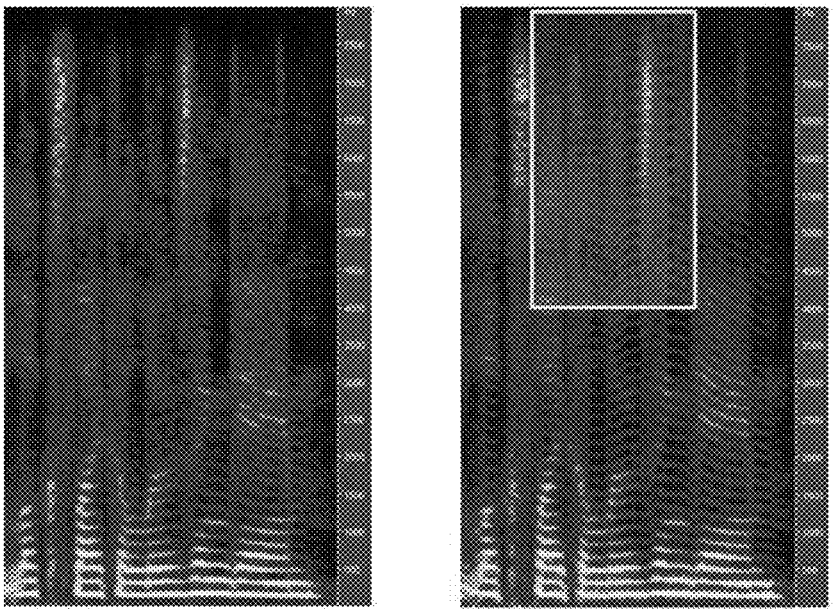
FIG. 9 is spectrograms for comparison between reference speech and speech re-synthesized with the PoN model.
Figure 10:
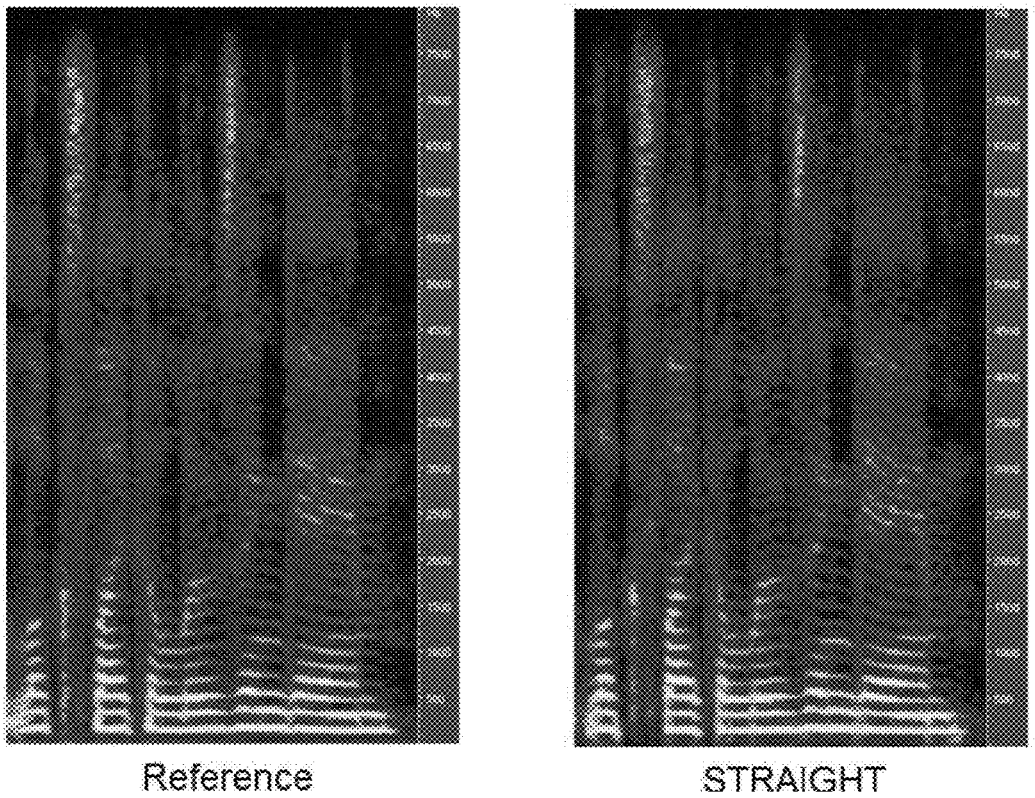
FIG. 10 is spectrograms for comparison between reference speech and speech re-synthesized with the STRAIGHT model.
Figure 11:
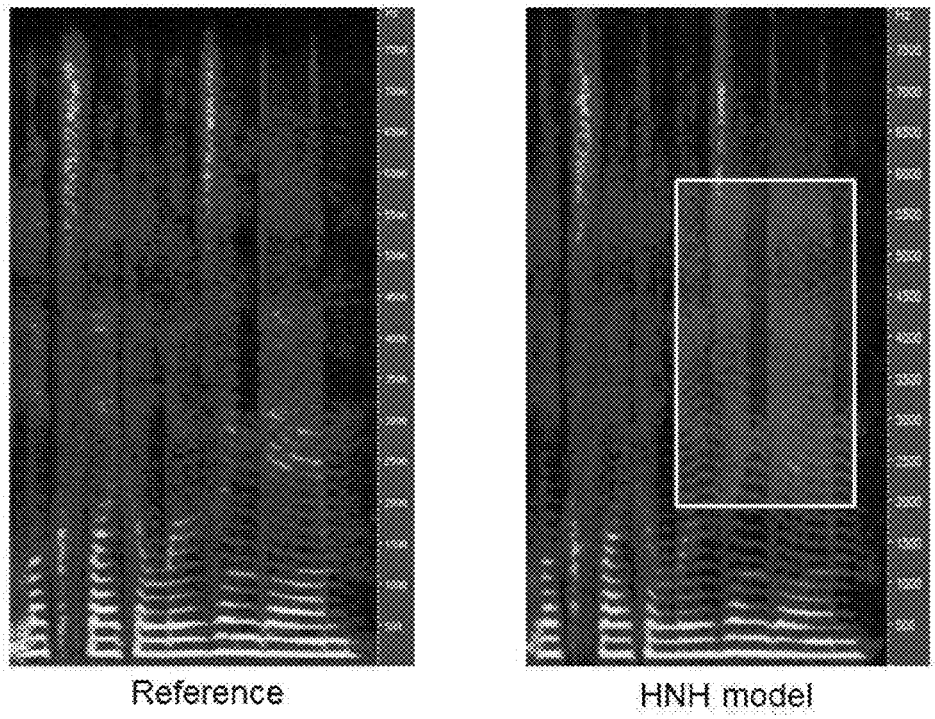
FIG. 11 is spectrograms for comparison between reference speech and speech re-synthesized with the HNH model.

FIG. 9 is spectrograms for comparison between reference speech and speech re-synthesized with the PoN model, FIG. 10 is spectrograms for comparison between reference speech and speech re-synthesized with the STRAIGHT model, and FIG. 11 is spectrograms for comparison between reference speech and speech re-synthesized with the HNH model.

Referring to FIG. 9, the spectrogram of speech synthesized by the PoN model indicates incorrect harmonics for whole band that reasons for muffling sound of synthesized speech. Referring to FIGS. 10 and 11, it may be seen that such incorrect harmonic representation is not generated.

Referring to FIG. 11, it may be seen in the HNH model that the modeling of the harmonic component and the non-harmonic component having an identical spectrum maintains the spectrum characteristics of the reference speech, and such a phenomenon is conspicuous between transition positions between unvoiced and voiced frames. It is understood that such characteristic is one factor to obtain good results in the object and subjective evaluations of FIG. 7.

<Quality Evaluation 2>

In the quality evaluation 2, the qualities of speeches synthesized from text labels by using the PoN model, the STRAIGHT model, and the HNH model were compared. The HMM-based speech synthesis systems were used for comparison.

The specifications of the systems for the evaluation are as follows.

First, CMU-ARCTIC-SLT and CMU-ARCTIC-AWB speech databases each having 1132 utterances were used as training data. The systems having the STRAIGHT model and the HNH model were made for both the SLT and AWB databases as a speaker-dependent system. Hence, four speech synthesis systems were set for this evaluation 2. Secondly, Speaker-dependent demo scripts for the HMM-based speech synthesis systems (version 2.2) were used in acoustic model training and parameter generation. Thirdly, The global variance option in the scripts was turned off to inhibit unnatural prosody in the synthesized results. Instead, conventional post-filtering using a coefficient was performed on the MFCC parameters generated. Fourthly, Parameter types and their sizes for the HTS systems were identically set as Table 1. Quality comparison was then conducted via a MOS test for the results from the three systems applying the same database for each. In this test, 20 English utterances were converted into a corresponding label sequence. Then, all systems generated the output parameters from the given text labels. Then, speech reconstruction was performed. Note that the same 11 participants as in the quality evaluation 1 participated in the tests.

Figure 12:
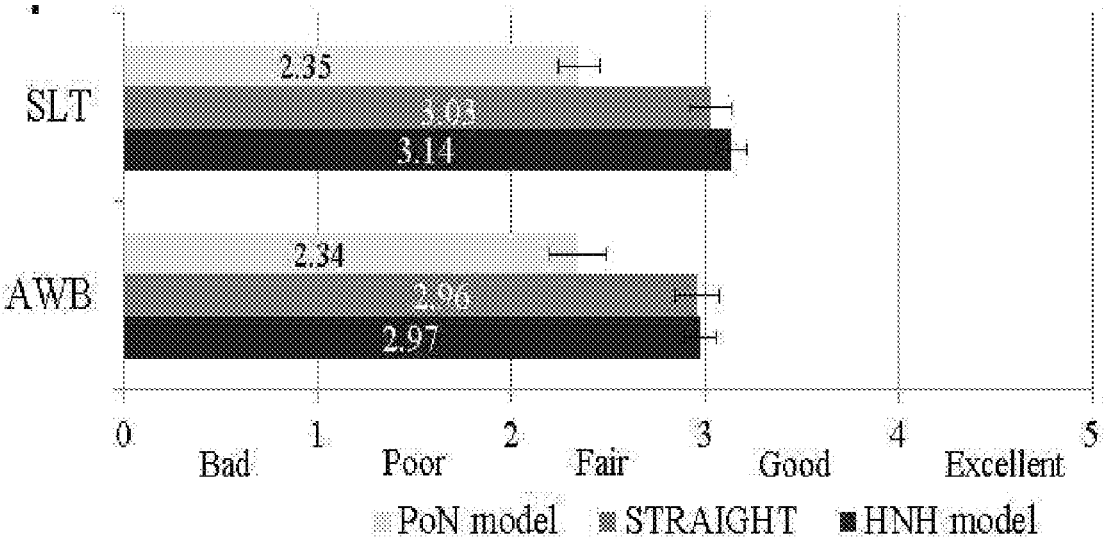
FIG. 12 is a diagram showing test results obtained by the quality evaluation 2.

FIG. 12 is a diagram showing test results. Referring to FIG. 12, it may be seen that when using the SLT database, the system with the HNH model achieved a high preference score with a moderate gap compared to the STRAIGHT model. However, it may be seen that when using the AWB database, similar preference scores were achieved for the STRAIGHT model and the HNH model.

Figure 13:
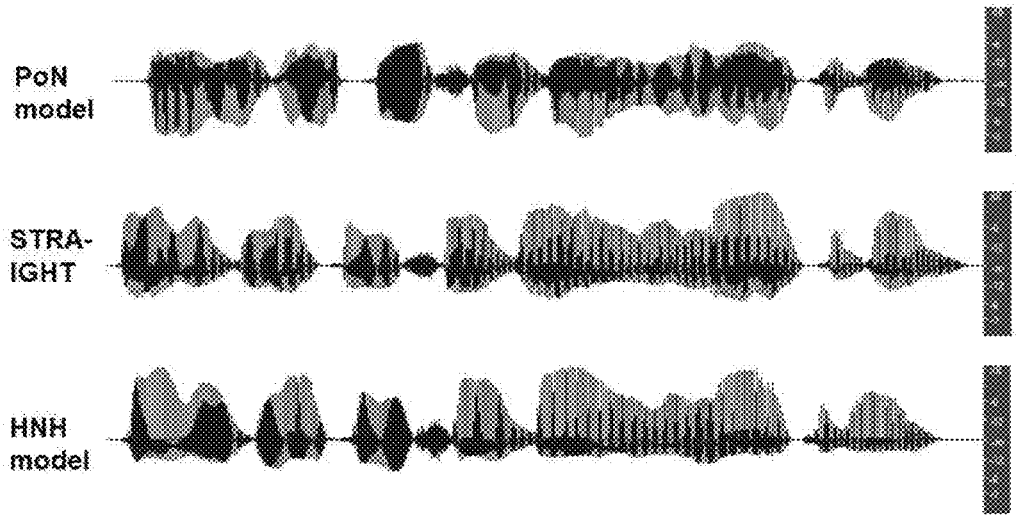
FIG. 13 is a graph showing waveforms of speeches synthesized with the PoN model, the STRAIGHT model, and the HNH model.
Figure 14:
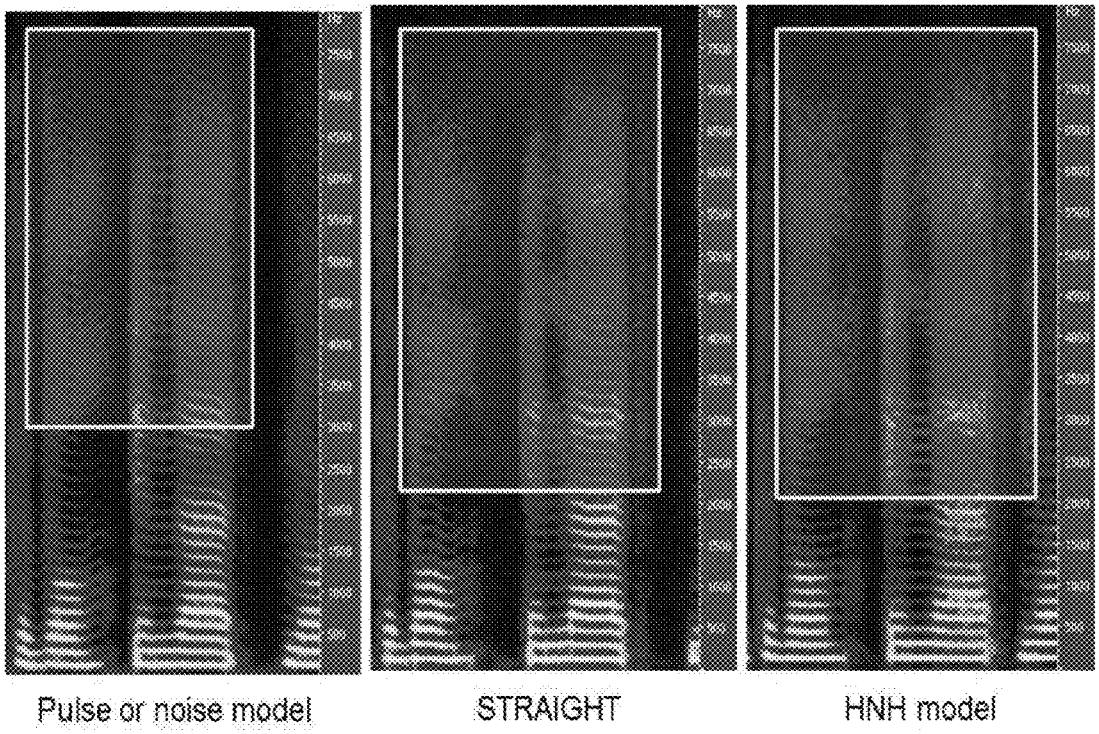
FIG. 14 is spectrograms of speeches synthesized with the above three models.

FIG. 13 is a graph showing waveforms of speeches synthesized with the PoN model, the STRAIGHT model, and the HNH model, and FIG. 14 is spectrograms of speeches synthesized with the above three models.

Referring to FIG. 14, it may be seen that the spectrum of a speech synthesized by the PoN model shows unreasonably high harmonic components, as described in quality evaluation 1. The spectrum of a speech synthesized with the STRAIGHT model shows quite high harmonic components, since the STRAIGHT model does not maintain the boundary information between harmonic and non-harmonic components of the target speeches in a database. However, the spectrum of a speech synthesized with HNH model shows clear boundary between harmonic and non-harmonic components for every frame, due to its two-band representation of spectrums by using shaping filters.

From statements of common participants, the speech synthesized with the HNH model sounded natural and smooth, through slightly less intelligible. In contrast, the speech synthesized with the STRAIGHT model sounded artificial, but more intelligible. Thus, from the test results and participants' perceptions of the synthesized speech, it may be concluded here that naturalness is treated as a more important factor than intelligibility in perceptual measurements of synthesized speech.

The present invention may include another embodiment as well as the above embodiment. For example, the gain value is used for maintaining the ratio of the harmonic and non-harmonic components. However, while the gain value is not applied, it will be possible to maintain the quality above a predetermined level. Therefore, it will be construed that an embodiment in which the gain value is not separately used as a data value is included in the embodiments of the present invention.

According to the present invention, since the harmonic and non-harmonic components are separately synthesized, the synthesized speech sounds more natural. This advantage is further needed for synthesized speech. Also, the present invention is advantageous in that it may represent speech with less data.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A speech analysis apparatus comprising:

a first parameter processor configured to extract a pitch value from speech information;

a second parameter processor configured to extract spectrum information from the speech information;

a third parameter processor configured to extract a maximum voiced frequency and allowing boundary information for respectively filtering a harmonic component and a non-harmonic component to be obtained;

a synthesizing processor configured to pseudo-synthesize speech by using the pitch value, the spectrum information, and the maximum voiced frequency which are extracted by the first parameter processor, the second parameter processor, and the third parameter processor, respectively; and a fourth parameter processor configured to extract a gain value by comparing energies of a harmonic component and a non-harmonic component synthesized by the synthesizing processor.

2. The speech analysis apparatus according to claim 1, wherein the third parameter processor comprises a first search filter, which allows an arbitrary frame to be classified into several sub-bands, and searches the sub-band having the greatest energy difference among the sub-bands.

3. The speech analysis apparatus according to claim 2, wherein the third parameter processor comprises a second search filter searching a specific position having the greatest amplitude between two adjacent samples in a region of the specific sub-band searched by the first search filter.

4. A speech synthesis apparatus allowing speech to be synthesized after a harmonic component and a non-harmonic component are separately generated, the apparatus comprising:

a low-pass filter that passes a signal having a frequency lower than a first cut-off frequency, the low-pass filter configured to perform a filtering when the harmonic component is generated;

a high-pass filter that passes a signal having a frequency higher than a second cut-off frequency, the high-pass filter configured to perform a filtering when the non-harmonic component is generated a parameter generating processor configured to generate parameters comprising at least a pitch value (p(m)), spectrum information (F(k,m)), a maximum voiced frequency (MVF)(v(m)), and a gain value (G) to synthesize instructed speech, wherein the gain value is a ratio of the gain value of the harmonic component and the gain value of the non-harmonic component in an arbitrary speech signal.

5. The speech synthesis apparatus according to claim 4, wherein the harmonic component and the non-harmonic component are classified using a maximum voice frequency.

6. The speech synthesis apparatus according to claim 4, wherein the maximum voiced frequency value is defined as a boundary frequency value between a section having a relatively large harmonic component and a section having a relatively small harmonic component.

7. The speech synthesis apparatus according to claim 6, wherein the maximum voiced frequency allows an arbitrary frame to be classified into several sub-bands, and is obtained by searching the sub-band having the greatest energy difference among the sub-bands.

8. The speech synthesis apparatus according to claim 7, wherein in the region of the searched sub-band, a specific position having the greatest amplitude between two adjacent samples is obtained.

9. The speech synthesis apparatus according to claim 4, further comprising a harmonic non-harmonic parameter database storing the parameters.

10. The speech synthesis apparatus according to claim 4, in order to generate the harmonic component, further comprising:

a first transformation processor configured to transform spectrum information into a time region to output frame information;

a boundary filter generating processor configured to generate a boundary filter of the harmonic component and the non-harmonic component by using a maximum voiced frequency; and a harmonic component generating processor configured to generate a harmonic speech signal by using the frame information, the boundary filter, and a pitch value.

11. The speech synthesis apparatus according to claim 10, wherein the harmonic component generating processor adjusts an output by using a gain value.

12. The speech synthesis apparatus according to claim 4, in order to generate the non-harmonic component, further comprising:

a second transformation processor configured to transform spectrum information into a time region to output frame information;

a boundary filter generating processor configured to generate a boundary filter of the harmonic component and the non-harmonic component by using a maximum voiced frequency; and a non-harmonic component generating processor configured to generate a non-harmonic speech signal by using the frame information and the boundary filter.

13. The speech synthesis apparatus according to claim 12, wherein the non-harmonic component generating processor adjusts an output by using a gain value.

14. A speech analysis synthesis system comprising:

a speech signal analyzing processor configured to analyze a speech signal;

a training processor configured to train a parameter analyzed by the speech signal analyzing processor;

a database storing the parameter trained by the training processor;

a parameter generating processor configured to extract the parameter corresponding to a specific character from the database when a character is inputted; and a synthesizing processor synthesizing speech by using the parameter, wherein the parameter comprises a pitch value, spectrum information, and a maximum voiced frequency (MVF) value which is defined as a boundary frequency value between a section having a relatively large harmonic component and a section having a relatively small harmonic component, and wherein the parameter comprises a gain value obtained by comparing energy of a harmonic component and energy of a non-harmonic component in a pseudo-synthesized signal using the pitch value, the spectrum information, and the MVF value.

15. The speech analysis synthesis system according to claim 14, wherein the gain value is a ratio of the gain value ($G^h$) of the harmonic component and the gain value ($G_{nh}$) of the non-harmonic component in an arbitrary speech signal.

16. The speech analysis synthesis system according to claim 14, wherein the harmonic component and the non-harmonic component are separately generated and then synthesized by the synthesizing processor.

* * * * *